US010357966B2

(12) United States Patent
Ito et al.

(10) Patent No.: US 10,357,966 B2
(45) Date of Patent: Jul. 23, 2019

(54) LIQUID JETTING HEAD AND METHOD FOR MANUFACTURING THE SAME

(71) Applicant: BROTHER KOGYO KABUSHIKI KAISHA, Nagoya-shi, Aichi-ken (JP)

(72) Inventors: Yuichi Ito, Mie-ken (JP); Keita Hirai, Nagoya (JP); Taisuke Mizuno, Yokkaichi (JP); Hideki Hayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/918,224

(22) Filed: Mar. 12, 2018

(65) Prior Publication Data

US 2018/0264807 A1 Sep. 20, 2018

(30) Foreign Application Priority Data

Mar. 15, 2017 (JP) ..... 2017-049880

(51) Int. Cl.
*B41J 2/045* (2006.01)
*B41J 2/14* (2006.01)
*B41J 2/16* (2006.01)

(52) U.S. Cl.
CPC ..... *B41J 2/04563* (2013.01); *B41J 2/14233* (2013.01); *B41J 2/161* (2013.01); *B41J 2/1607* (2013.01); *B41J 2/1623* (2013.01); *B41J 2/1626* (2013.01); *B41J 2/1646* (2013.01); *B41J 2002/14241* (2013.01); *B41J 2002/14419* (2013.01); *B41J 2002/14491* (2013.01); *B41J 2202/12* (2013.01)

(58) Field of Classification Search
CPC .. B41J 2/04563; B41J 2/1607; B41J 2/14233; B41J 2002/14241; B41J 2002/14491; B41J 2002/14419; B41J 2/14072
See application file for complete search history.

(56) References Cited

U.S. PATENT DOCUMENTS

2005/0190232 A1* 9/2005 Lee ..... B41J 2/14137 347/45
2009/0295858 A1* 12/2009 Ito ..... B41J 2/0456 347/17
2013/0215172 A1* 8/2013 Kaneko ..... B41J 2/04581 347/10
2015/0266295 A1* 9/2015 Miyazaki ..... B41J 2/14201 347/71

FOREIGN PATENT DOCUMENTS

JP 8-58084 A 3/1996
JP 2010-149293 A 7/2010

* cited by examiner

*Primary Examiner* — Geoffrey S Mruk
(74) *Attorney, Agent, or Firm* — Merchant & Gould P.C.

(57) ABSTRACT

A liquid jetting head includes a flow channel substrate formed with pressure chambers, an actuator covering the pressure chambers, and a temperature sensor. A dummy pressure chamber is formed in a surface, of the flow channel substrate, in which the pressure chambers are open. The actuator includes: a vibration plate which covers the pressure chambers and the dummy pressure chamber and which has a first surface facing the pressure chambers and a second surface opposite to the first surface, and a piezoelectric body arranged on the second surface of the vibration plate to face the pressure chambers. The temperature sensor is arranged on the second surface of the vibration plate at a position facing the dummy pressure chamber.

16 Claims, 9 Drawing Sheets

LIQUID JETTING HEAD AND METHOD FOR MANUFACTURING THE SAME

CROSS REFERENCE TO RELATED APPLICATION

The present application claims priority from Japanese Patent Application No. 2017-049880 filed on Mar. 15, 2017, the disclosure of which is incorporated herein by reference in its entirety.

BACKGROUND

Field of the Invention

The present invention relates to a liquid jetting head provided with a temperature sensor, and a method for manufacturing the same.

Description of the Related Art

Conventionally, there are known liquid jetting heads provided with a temperature sensor. For example, in a liquid jetting head disclosed in Japanese Patent Application Laid-open No. 2010-149293, grooves (pressure chambers) are formed in an actuator plate, and a temperature sensor is arranged on a surface of a cover plate which covers the grooves.

SUMMARY

According to the liquid jetting head disclosed in Japanese Patent Application Laid-open No. 2010-149293, by deforming lateral walls of the grooves of the actuator plate, liquid inside the grooves is jetted from nozzles. The cover plate does not deform itself when the liquid is jetted, and its thickness is comparatively large. The temperature sensor is arranged on such a cover plate and, therefore, cannot accurately detect the temperature of the liquid inside flow channels of a flow channel substrate.

An object of the present teaching is to provide a liquid jetting head and a method for manufacturing the same which are capable of accurately detecting the temperature of liquid inside flow channels of a flow channel substrate.

According to a first aspect of the present teaching, there is provided a liquid jetting head including: a flow channel substrate in which pressure chambers are formed; an actuator covering the pressure chambers; and a temperature sensor, wherein a dummy pressure chamber is formed in a surface, of the flow channel substrate, in which the pressure chambers are open; the actuator includes: a vibration plate covering the pressure chambers and the dummy pressure chamber and having a first surface facing the pressure chambers and a second surface opposite to the first surface; and a piezoelectric body arranged on the second surface of the vibration plate to face the pressure chambers, and the temperature sensor is arranged on the second surface of the vibration plate at a position facing the dummy pressure chamber.

According to a second aspect of the present teaching, there is provided a method for manufacturing a liquid jetting head, the method including: forming a vibration plate on a surface of a flow channel substrate formed with pressure chambers and a dummy pressure chamber, to cover the pressure chambers and the dummy pressure chamber; forming a layer of a predetermined material on a first surface, of the vibration plate, which is on a side opposite to a second surface facing the pressure chambers and the dummy pressure chamber, after forming the vibration plate; forming a temperature sensor by etching the layer after forming the layer, such that the layer is remained at a position facing the dummy pressure chamber; and forming a piezoelectric body on the first surface of the vibration plate at a position facing the pressure chambers, after forming the temperature sensor.

DESCRIPTION OF THE EMBODIMENTS

First Embodiment

Figure 1:
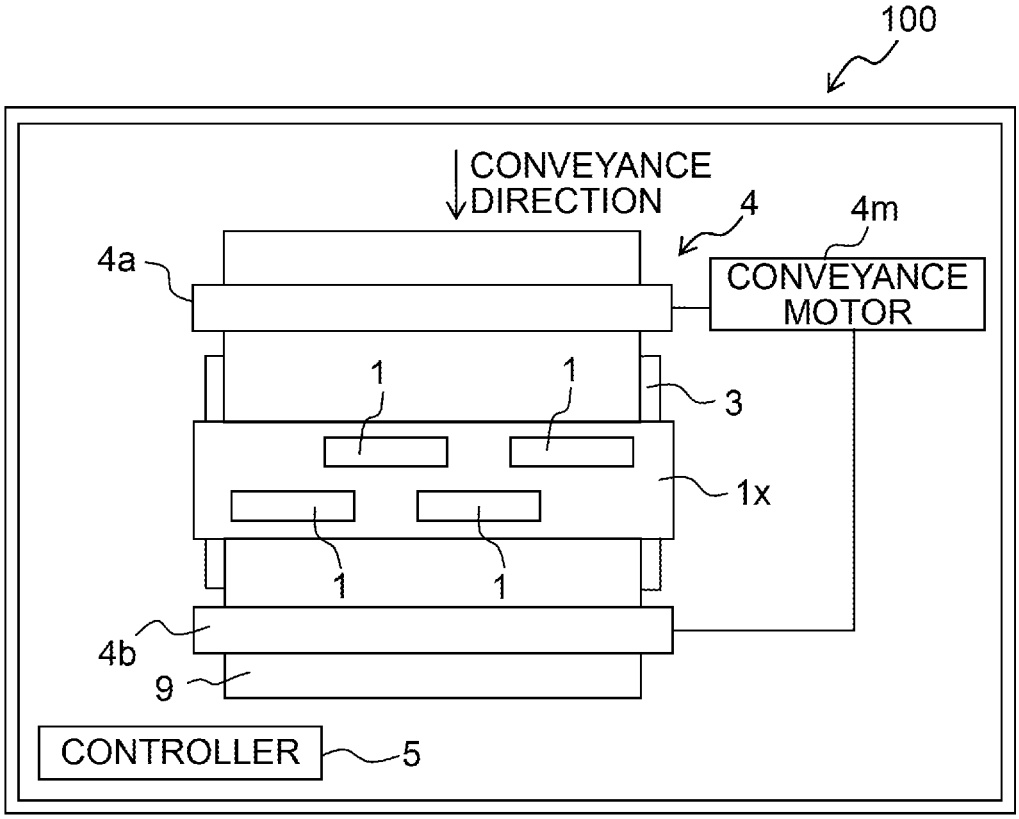
FIG. 1 is a schematic plan view of a printer provided with heads according to a first embodiment of the present teaching.

First, referring to FIG. 1, an explanation will be made on an overall configuration of a printer 100 provided with a head unit 1*x*. The printer 100 is mainly provided with the head unit 1*x*, a platen 3, a conveyance mechanism 4, and a controller 5. The head unit 1*x* includes heads 1 according to a first embodiment of the present teaching.

The head unit 1*x* is of a line type (that is, a type of jetting ink to paper 9 with its position being fixed), and is elongate in a direction orthogonal to a conveyance direction. The head unit 1*x* includes four heads 1 arranged zigzag along the direction orthogonal to the conveyance direction. The four heads 1 have the same structure with each other. Each of the heads 1 jets the ink from a plurality of nozzles 11*n* (see FIGS. 2 and 3).

The platen 3 is arranged below the head unit 1*x*. The ink is jetted from the respective heads 1 onto the paper 9 supported by the platen 3.

The conveyance mechanism 4 has two pairs of rollers 4*a* and 4*b* arranged to sandwich the platen 3 in the conveyance direction. A conveyance motor 4*m* drives the two rollers constituting each pair of rollers 4*a* and 4*b* to rotate in mutually opposite directions with the paper 9 nipped therebetween. By virtue of this, the paper 9 is conveyed in the conveyance direction.

Based on a recording command inputted from an external device such as a PC or the like, the controller 5 controls the four heads 1, the conveyance motor 4*m* and the like to record image on the paper 9.

Next, referring to FIGS. 2 to 6, an explanation will be made on a configuration of the heads 1. Each of the heads 1 has a flow channel substrate 11, an actuator unit 12, a temperature sensor 13, a tank 14, a protection member 15, and a COF 18.

Figure 2:
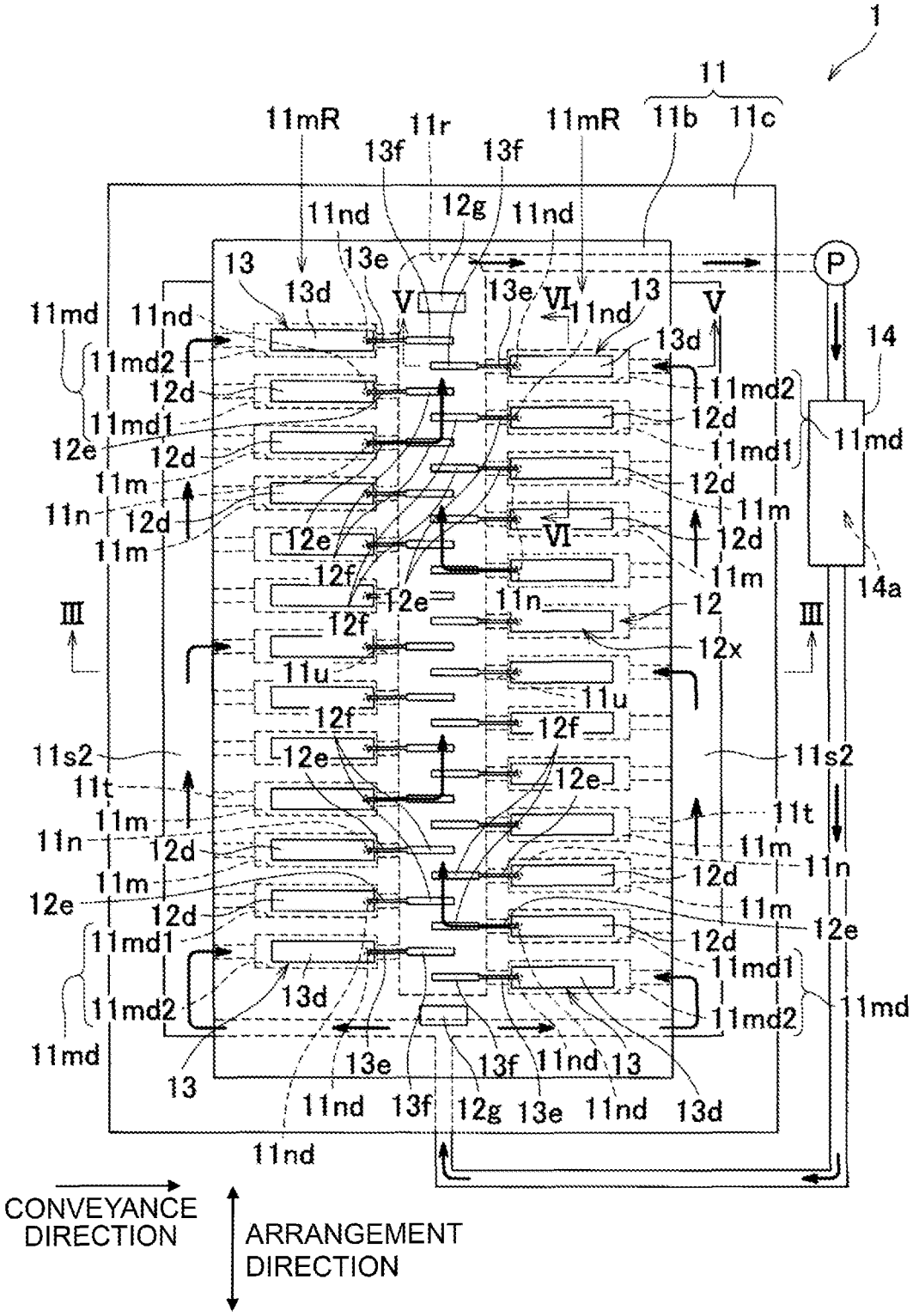
FIG. 2 is a plan view of one of the heads (omitting illustration of a reservoir member, a protection member, a COF, and a protection film).
Figure 3:
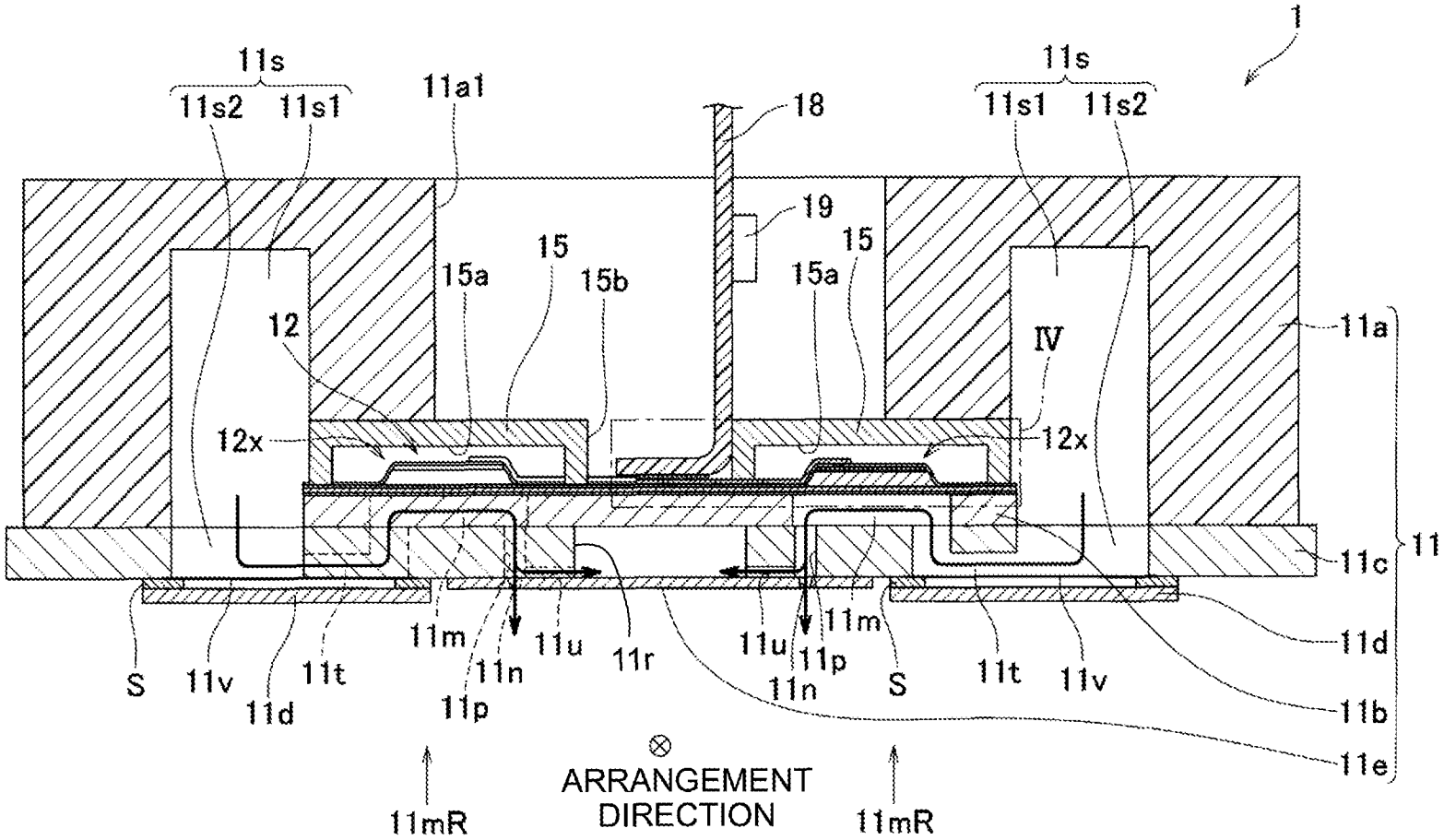
FIG. 3 is a cross-sectional view along a line of FIG. 2.

As depicted in FIG. 3, the flow channel substrate 11 has a reservoir member 11*a*, a pressure chamber plate 11*b*, a flow channel plate 11*c*, a protection plate 11*d*, and a nozzle plate 11*e*, and is constructed from those members which are adhered with each other. As depicted in FIGS. 2 and 3, the flow channel substrate 11 is formed therein with a plurality of pressure chambers 11*m*, a plurality of dummy pressure chambers 11*md*, the plurality of nozzles 11*n*, a plurality of dummy nozzles 11*nd*, supply flow channels 11*s*, and a feedback flow channel 11*r*.

The pressure chamber plate 11*b* is formed of a silicon single crystal substrate where the plurality of pressure chambers 11*m* and the plurality of dummy pressure chambers 11*md* are formed to penetrate therethrough. That is, the dummy pressure chambers 11*md* are formed in the surface of the pressure chamber plate 11*b* in which the chambers 11*m* are open. The pressure chambers 11*m* and the dummy pressure chambers 11*md* have the same shape and same size with each other.

As depicted in FIG. 2, the pressure chambers 11*m* are arranged to form two pressure chamber rows 11*m*R. The pressure chambers 11*m* forming each pressure chamber row 11*m*R are arranged at regular intervals in an arrangement direction (orthogonal to the conveyance direction). The two pressure chamber rows 11*m*R are arranged in a direction orthogonal to the arrangement direction (a direction parallel to the conveyance direction). The pressure chambers 11*m* are arranged in a zigzag pattern to differ from each other in position along the arrangement direction.

The dummy pressure chambers 11*md* are arranged in such a manner as two at the opposite ends of each pressure chamber row 11*m*R. The pressure chambers 11*m* and the dummy pressure chambers 11*md* are arranged at regular intervals along the arrangement direction of the pressure chambers 11*m*. Such two dummy pressure chambers 11*md* each include an adjacent dummy pressure chamber 11*md*1 and a distant dummy pressure chamber 11*md*2. The adjacent dummy pressure chamber 11*md*1 is adjacent in the arrangement direction to the pressure chambers 11*m* forming the respective pressure chamber rows 11*m*R. The distant dummy pressure chamber 11*md*2 is more distant in the arrangement direction from the pressure chambers 11*m* than the adjacent dummy pressure chamber 11*md*1.

The flow channel plate 11*c* has a plane size larger than the pressure chamber plate 11*b* to some degree, and is attached on the lower surface of the pressure chamber plate 11*b*. As depicted in FIG. 3, the flow channel plate 11*c* is formed therein with manifolds 11*s*2 which are part of the supply flow channel 11*s*, a flow channel 11*t* connecting the manifolds 11*s*2 and each pressure chamber 11*m*, a descender 11*p* connecting each pressure chamber 11*m* and the corresponding nozzle 11*n*, a throttle 11*u* connecting the descender 11*p* and the feedback flow channel 11*r*, and the feedback flow channel 11*r*. The manifolds 11*s*2 and the feedback flow channel 11*r* penetrate through the flow channel plate 11*c* in the thickness direction, and open at the upper and lower surfaces of the flow channel plate 11*c*.

The two manifold 11*s*2 are arranged, as depicted in FIG. 2, to sandwich the two pressure chamber rows 11*m*R in the conveyance direction. Each manifold 11*s*2 extends in the arrangement direction. The feedback flow channel 11*r* extends in the arrangement direction between the two pressure chamber rows 11*m*R. Both the manifolds 11*s*2 and the feedback flow channel 11*r* are in communication with not only the plurality of pressure chambers 11*m* but also the plurality of dummy pressure chambers 11*md*. That is, the respective dummy pressure chambers 11*md* are filled with the ink in the flow channel substrate 11.

As depicted in FIG. 3, a flexible damper film 11*v* is attached on the lower surface of the flow channel plate 11*c* to cover the manifolds 11*s*2. The damper film 11*v* has a function of attenuating pressure variation of the ink inside the manifolds 11*s*2. A frame-like spacer S is fixed at the periphery of the damper film 11*v*.

The protection plate 11*d* is attached on the lower surface of the spacer S to cover the damper film 11*v*. The damper film 11*v* faces the protection plate 11*d* across an interspace, and is protected by the protection plate 11*d*.

The nozzle plate 11*e* is formed with the plurality of nozzles 11*n* and the plurality of dummy nozzles 11*nd* penetrating therethrough. The plurality of nozzles 11*n* are in respective communication with the plurality of pressure chambers 11*m* while the plurality of dummy nozzles 11*nd* are in respective communication with the plurality of dummy pressure chambers llmd. The plurality of nozzles 11*n* and the plurality of dummy nozzles 11*nd* have the same shape and same size with each other. The nozzle plate 11*e* is attached on the lower surface of the flow channel plate 11*c* to cover the feedback flow channel 11*r*.

As depicted in FIG. 2, in the same manner as the plurality of pressure chambers 11*m*, the plurality of nozzles 11*n* are arranged in two rows and arranged zigzag to differ from each other in position along the arrangement direction.

In the same manner as the plurality of dummy pressure chambers 11*md*, the plurality of dummy nozzles 11*nd* are arranged two at the opposite ends of each nozzle row.

The ink is jetted from the plurality of nozzles 11*n* with a change in the volume of the pressure chambers 11*m* corresponding to the drive of an active portion 12*x* of an actuator 12. On the other hand, no ink is jetted from the plurality of dummy nozzles 11*nd* because no active portion 12*x* is provided in a position facing a distant dummy pressure chamber 11*md*2, or because an active portion 12*x* is provided in a position facing an adjacent dummy pressure chamber 11*md*1 but that active portion 12*x* will not be driven.

As depicted in FIG. 3, the reservoir member 11*a* is formed with two reservoirs 11*s*1 which are part of the supply flow channel 11*s*. In the same manner as the manifolds 11*s*2, the two reservoirs 11*s*1 are arranged to sandwich the two pressure chamber rows 11*m*R in the conveyance direction. Each reservoir 11*s*1 extends in the arrangement direction. Each reservoir 11*s*1 opens at the lower surface of the reservoir member 11*a*. The reservoir member 11*a* is adhered to the upper surface of the flow channel plate 11*c* and to the upper surface of the protection member 15 such that the two reservoirs 11*s*1 overlap with the two manifolds 11*s*2.

As depicted in FIG. 2, the supply flow channel 11*s* and the feedback flow channel 11*r* are in communication with a retainment chamber 14*a* of the tank 14, respectively, through a tube or the like. The retainment chamber 14*a* retains the ink. The ink retained in the retainment chamber 14*a* is caused to flow into the supply flow channel 11*s* by the drive of a pump P, and supplied from the opposite outer sides of the two pressure chamber rows 11*m*R to the plurality of pressure chambers 11*m* and the plurality of dummy pressure chambers 11*md* forming the respective pressure chamber rows 11*m*R. Part of the ink supplied to the respective pressure chambers 11*m* is jetted from the nozzles 11*n*, whereas the rest of the ink flows into the feedback flow channel 11*r* extending between the two pressure chamber rows 11*m*R to flow back into the retainment chamber 14*a*. The ink supplied to the respective dummy pressure chambers 11*md* flows into the feedback flow channel 11*r* extending between the two pressure chamber rows 11*m*R to flow back into the retainment chamber 14*a*.

Figure 4:
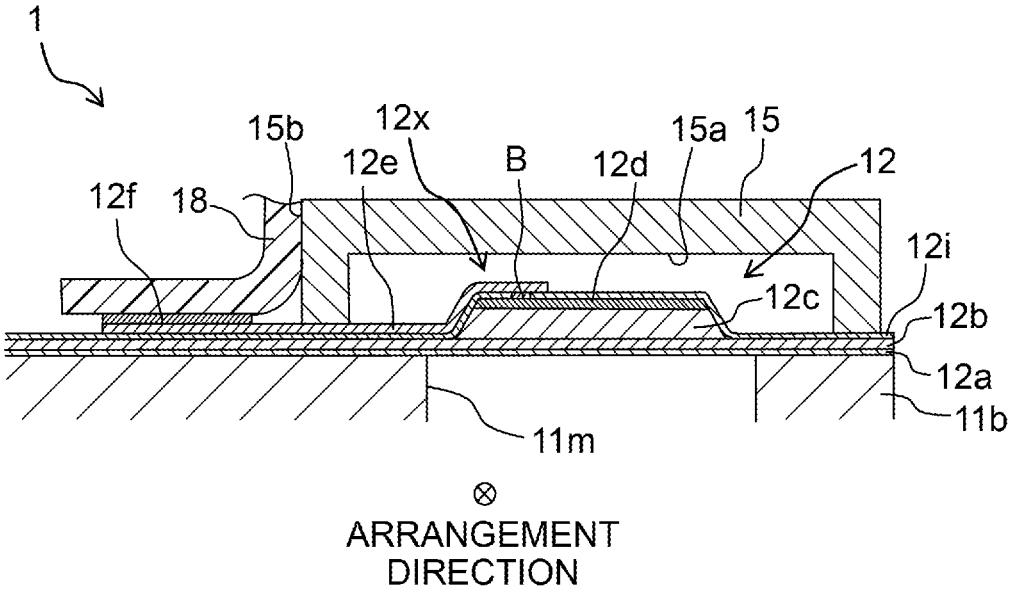
FIG. 4 depicts an area IV of FIG. 3.

The actuator 12 is arranged, as depicted in FIG. 4, on an upper surface of the pressure chamber plate 11*b*. The actuator 12 includes, in order from below, a vibration plate 12*a*, a common electrode 12*b*, a plurality of piezoelectric bodies 12*c*, and a plurality of individual electrodes 12*d*.

Figure 6:
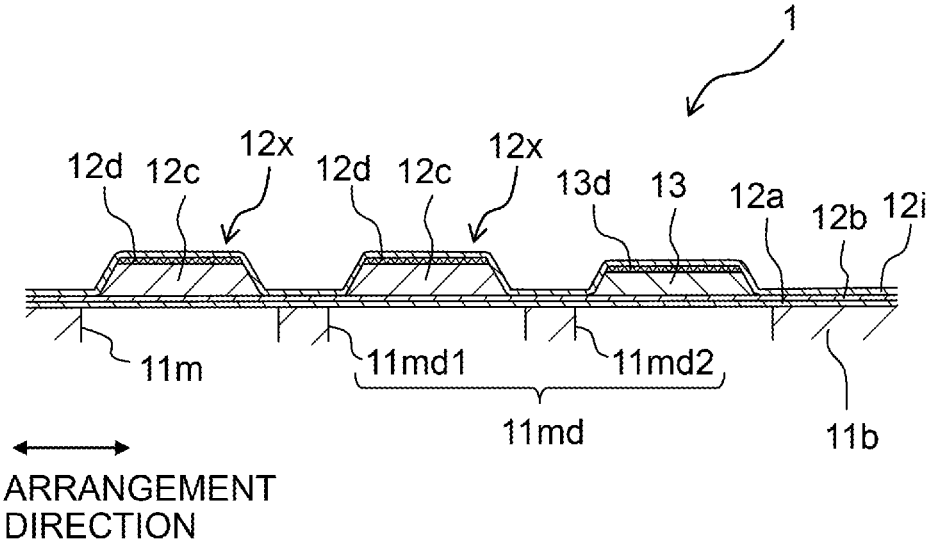
FIG. 6 is a cross-sectional view along the line VI-VI of FIG. 2 (omitting illustration of the reservoir member and the protection member).

The vibration plate 12*a* and the common electrode 12*b* are formed on almost the entire upper surface of the pressure chamber plate 11*b*, as depicted in FIG. 6, to cover not only the plurality of pressure chambers 11*m* but also the plurality of dummy pressure chambers 11*md*. On the other hand, the plurality of piezoelectric bodies 12*c* and the plurality of individual electrodes 12*d* are arranged respectively for the pressure chambers 11*m* and the adjacent dummy pressure chambers 11*md*1 (that is, to face the pressure chambers 11*m* and the adjacent dummy pressure chambers 11*md*1 respectively).

The vibration plate 12*a* is a film of silicon dioxide formed by oxidizing a surface of the silicon single crystal substrate used to form the pressure chamber plate 11*b*.

The common electrode 12*b* is used commonly for the plurality of pressure chambers 11*m*, and arranged in a position between the vibration plate 12*a* and the plurality of piezoelectric bodies 12*c* to face the plurality of pressure chambers 11*m* and the plurality of dummy pressure chambers 11*md*.

The plurality of piezoelectric bodies 12*c* are made of a piezoelectric material such as lead zirconate titanate (or PZT) or the like. The plurality of piezoelectric bodies 12*c* are arranged in a position on the upper surface of the common electrode 12*b* to face the plurality of pressure chambers 11*m* and the plurality of adjacent dummy pressure chambers 11*md*1, respectively. The piezoelectric body 12*c* is not provided but a temperature sensor 13 is provided in a position to face each distant dummy pressure chamber 11*md*2. The piezoelectric bodies 12*c* and the temperature sensors 13 are arranged on the upper surface of the vibration plate 12*a* (the other surface of the vibration plate 12*a* than the surface facing the plurality of pressure chambers 11*m*) via the common electrode 12*b*.

The plurality of individual electrodes 12*d* are formed on the upper surfaces of the respective plurality of piezoelectric bodies 12*c* (that is, the surfaces on a side opposite to the vibration plate 12*a*). That is, the plurality of individual electrodes 12*d* are arranged in positions respectively facing the plurality of pressure chambers 11*m* and the plurality of adjacent dummy pressure chambers 11*md*1.

The part of each piezoelectric body 12*c* interposed between the individual electrode 12*d* and the common electrode 12*b* functions as the active portion 12*x* which deforms with an application of voltage to the individual electrode 12*d*. That is, the actuator 12 has a plurality of active portions 12*x* facing the pressure chambers 11*m* or the adjacent dummy pressure chambers 11*md*1. By driving the active portions 12*x* facing the pressure chambers 11*m* (that is, by deforming the active portions 12*x* with the application of voltage to the individual electrodes 12*d* (such that the active portions 12*x* become convex toward the pressure chambers 11*m*)), the pressure chambers 11*m* change in volume. By virtue of this, a pressure is applied to the ink inside the pressure chambers 11*m*, thereby jetting the ink from the nozzles 11*n*. On the other hand, the active portions 12*x* facing the adjacent dummy pressure chambers 11*md*1 are not driven such that the adjacent dummy pressure chambers 11*md*1 do not change in volume and thus the ink is not jetted from the dummy nozzles 11*nd* in communication with the adjacent dummy pressure chambers 11*md*1.

The temperature sensor 13 is arranged on the upper surface of the common electrode 12*b* in a position facing each of the plurality of distant dummy pressure chambers 11*md*2. That is, as depicted in FIG. 2, the temperature sensors 13 are arranged one at each of the opposite ends of each pressure chamber row 11*m*R. In other words, there are provided two temperature sensors 13 arranged on the upstream side of the pressure chambers 11*m* and two temperature sensors 13 arranged on the downstream side of the pressure chambers 11*m*, in the flow direction of the ink in each manifold 11*s*2.

Each of the temperature sensors 13 is, for example, an NTC thermistor (Negative Temperature Coefficient Thermistor) made from a material whose electric resistance changes with temperature (such as a combined metal oxide of Mn, Ni, Co and the like in the first embodiment). The temperature detected by the temperature sensor 13 is used in a jet control (to determine the drive voltage, drive pulse width, and pulse number applied to the active portion 12*x*, etc.).

The temperature sensor 13 has a smaller thickness than the piezoelectric body 12*c* (see FIG. 6).

An electrode 13*d* for temperature sensors (sensor electrode) is arranged on the upper surface of the temperature sensor 13 (the surface on the side opposite to the vibration plate 12*a*). The sensor electrode 13*d* is made of the same material as the individual electrode 12*d* (for example, iridium (Ir), platinum (Pt), or the like).

A protection film 12*i* is provided on the upper surface of each sensor electrode 13*d*, the upper surface of each individual electrode 12*d*, and the upper surface of the common electrode 12*b*, to cover the part without providing the piezoelectric body 12*c* and the temperature sensor 13, and the lateral side of each piezoelectric body 12*c*. The protection film 12*i* protects the piezoelectric body 12*c*. The protection film 12*i* has a function of preventing moisture in the air from ingression to the piezoelectric body 12*c*. The protection films 12*i* are made of, for example, aluminum oxide (alumina: $Al_2O_3$), or the like.

The protection films 12*i* are formed with through holes at positions respectively facing the individual electrodes 12*d* and the sensor electrodes 13*d*. Each through hole is filled with a conductive material B. Each individual electrode 12*d* is connected to a wire 12*e* via the conductive material B filling the corresponding through hole (see FIG. 4). As depicted in FIG. 2, each wire 12*e* extends in the direction orthogonal to the arrangement direction from the corresponding individual electrode 12*d* toward an area between the two pressure chamber rows 11*m*R. An individual contact point 12*f* is formed at the fore-end of each wire 12*e*.

Figure 5:
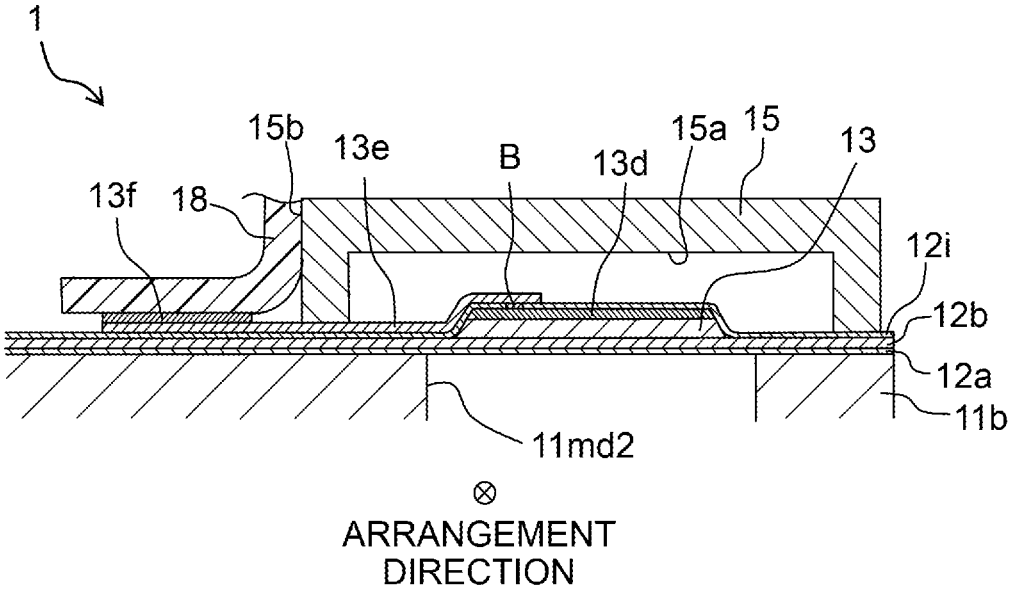
FIG. 5 is a cross-sectional view along a line V-V of FIG. 2 and corresponds to FIG. 4.

Each sensor electrode 13*d* is connected to a wire 13*e* via the conductive material B filling the corresponding through hole (see FIG. 5). Each wire 13*e* extends in the direction orthogonal to the arrangement direction from the corresponding sensor electrode 13*d* toward the area between the two pressure chamber rows 11*m*R. A sensor contact point 13*f* is formed at the fore-end of each wire 13*e*.

The wires 12*e* and 13*e* and the conductive material B are made of the same material with each other. By virtue of this, it is possible to reduce the number of processes for manufacturing the heads 1.

The wires 12*e* and 13*e* and the contact points 12*f* and 13*f* are arranged, respectively, in a zigzag pattern along the arrangement direction in the area between the two pressure chamber rows 11*m*R.

A pair of common contact points 12*g* are provided to interpose the individual contact points 12*f* and the sensor contact points 13*f* in the arrangement direction. The pair of common contact points 12*g* are connected electrically with the common electrode 12*b* via the conductive material (not depicted) filling the through hole penetrating through the protection films 12*i*.

As depicted in FIG. 3, the protection member 15 has a pair of concave portions 15*a* extending respectively in the arrangement direction. Each concave portion 15*a* opens at the lower surface of the protection member 15. The protection member 15 is attached on the upper surface of the pressure chamber plate 11*b* via the vibration plate 12*a*, the common electrode 12*b* and the protection films 12*i*, to accommodate the plurality of piezoelectric bodies 12*c* corresponding to the respective pressure chamber rows 11*m*R inside each concave portion 15*a*.

The protection member 15 has a through hole 15*b* at the center according to the direction orthogonal to the arrangement direction. The reservoir member 11*a* has a through hole 11*a*1 at the center according to the direction orthogonal to the arrangement direction. The contact points 12*f*, 13*f* and 12*g* are exposed from the through holes 15*b* and 11*a*1. One end of the COF 18 is connected electrically with the respective contact points 12*f*, 13*f* and 12*g*. The COF 18 passes through the through holes 15*b* and 11*a*1 and extends upward to let the other end be connected electrically with the controller 5 (see FIG. 1).

As depicted in FIG. 3, a driver IC 19 is mounted between the one end and the other end of the COF 18. The driver IC 19 is connected electrically with each of the contact points 12*f*, 13*f* and 12*g* and the controller 5 via wires (not depicted) formed on the COF 18. Based on a signal from the controller 5, the driver IC 19 generates a drive signal for driving the active portions 12*x*, and supplies the drive signal to the respective individual electrodes 12*d*. The common electrode 12*b* is maintained at the ground potential. Further, the driver IC 19 receives an electrical signal due to a thermoelectric conversion by the temperature sensors 13, and sends that signal to the controller 5.

Further, from the point of view of suppressing a problem that a difference occurs in the shapes of the piezoelectric body 12*c* and the individual electrode 12*d* between the center and the terminal according to the arrangement direction, so as to give rise to a difference in jet property (the size, jet speed, jet direction of the ink droplets jetted from the nozzle 11*n*), etc., the piezoelectric body 12*c* and the individual electrode 12*d* are provided in positions facing each adjacent dummy pressure chamber 11*md*1, and the active portion 12*x* is formed but the drive signal is not supplied to that individual electrode 12*d* such that the active portion 12*x* will not be driven.

Figure 7:
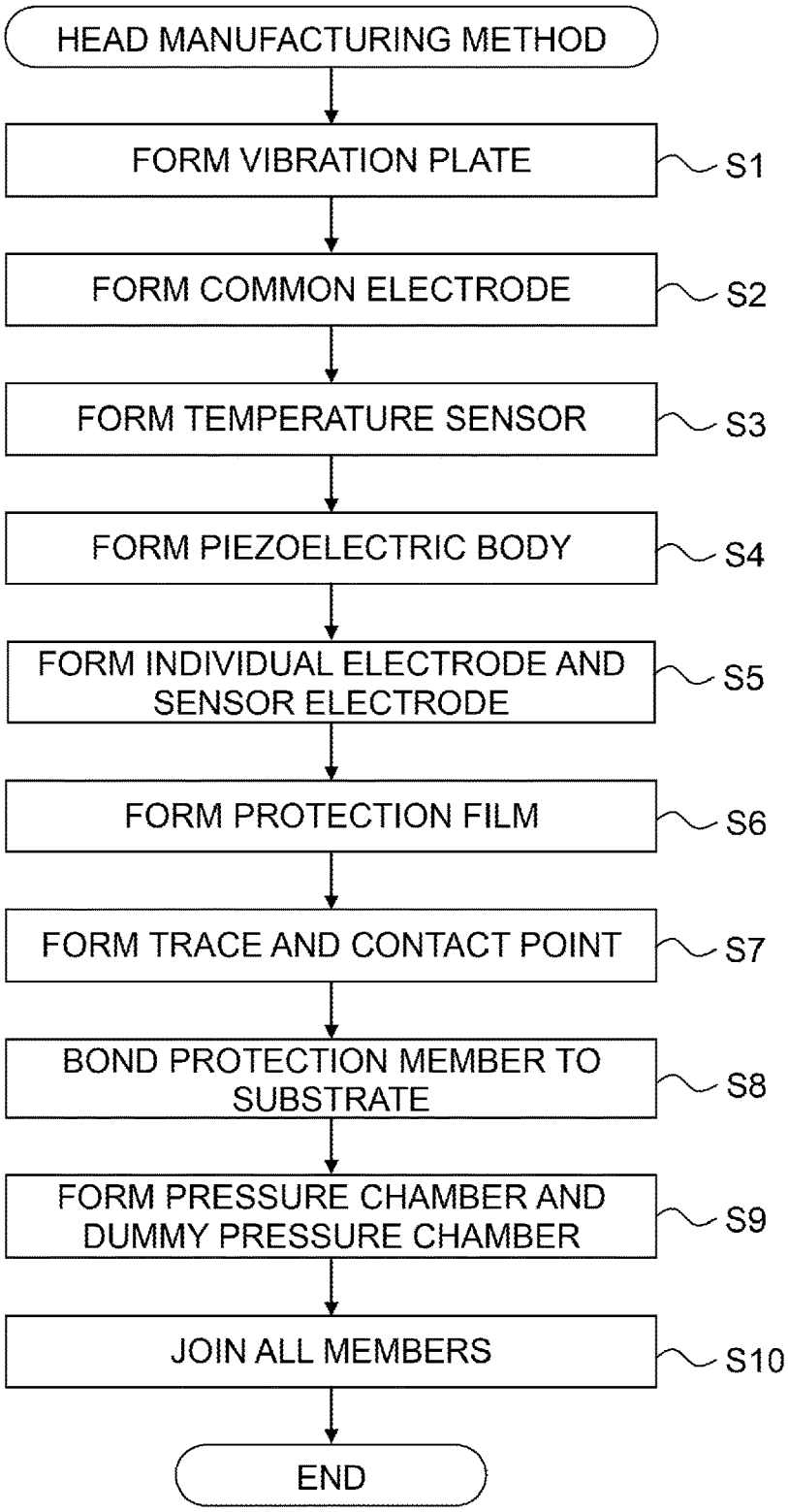
FIG. 7 is a flowchart depicting a method for manufacturing the head.

Next, referring to FIGS. 7 and 8, a method for manufacturing the head 1 will be explained.

Figure 8A:
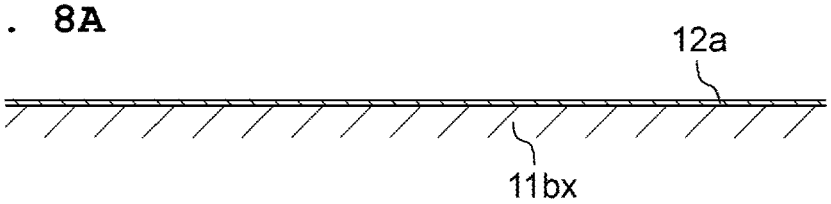
FIGS. 8A to 8G are cross-sectional views depicting a procedure of manufacturing the head corresponding to FIG. 6.

First, as depicted in FIG. 8A, the vibration plate 12*a* made of a silicon dioxide film is formed, by way of thermal oxidation and the like, on a surface of a silicon single crystal substrate 11*bx* to become later the pressure chamber plate 11*b* (S1: vibration plate formation process). At this stage, the plurality of pressure chambers 11*m* and the plurality of dummy pressure chambers 11*md* have not yet been formed in the silicon single crystal substrate 11*bx*.

Figure 8B:
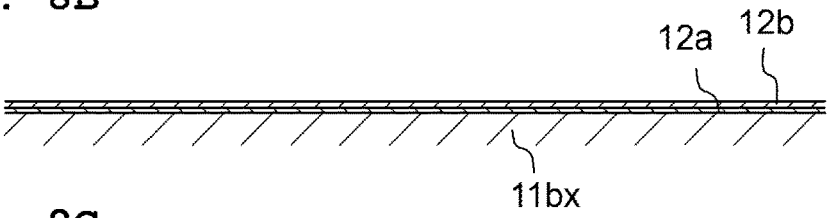

Next, as depicted in FIG. 8B, the common electrode 12*b* is formed on the upper surface of the vibration plate 12*a* by way of sputtering, for example, with iridium (Ir) or platinum (Pt) as the target (S2).

Figure 8C:
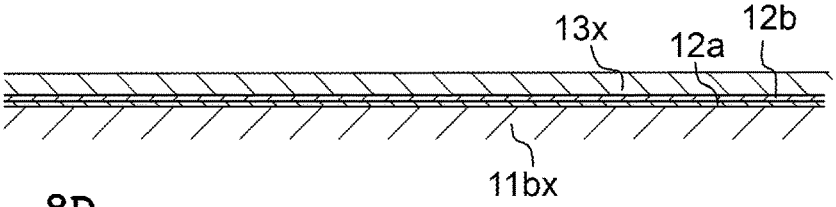
Figure 8D:
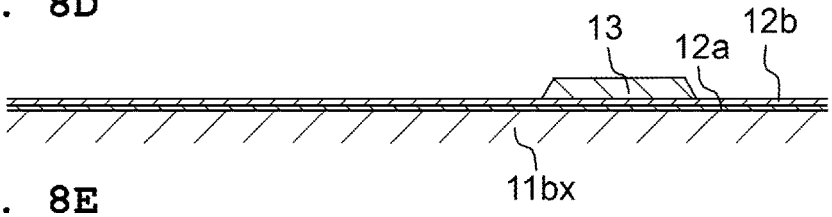

Next, as depicted in FIG. 8C, a layer 13*x* to become later the temperature sensor 13 is formed on the upper surface of the common electrode 12*b* by way of sputtering with a material whose electric resistance changes with temperature as the target (a combined metal oxide of Mn, Ni, Co and the like in the first embodiment). That is, the layer 13*x* made of a material to construct the temperature sensor 13 is formed on the upper surface of the vibration plate 12*a* via the common electrode 12*b*. Then, as depicted in FIG. 8D, an etching process is carried out to let the layer 13*x* remain in the position facing each distant dummy pressure chamber 11*md*2 (the position to form the distant dummy pressure chamber 11*md*2 in a later process but, at this stage, the distant dummy pressure chamber 11*md*2 has not yet been formed in the silicon single crystal substrate 11*bx*), to form the temperature sensor 13 (S3: temperature sensor formation process).

Figure 8E:
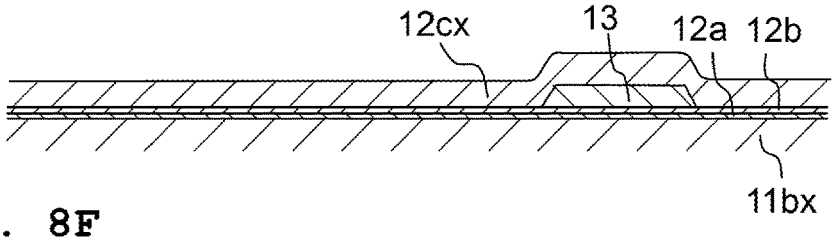
Figure 8F:
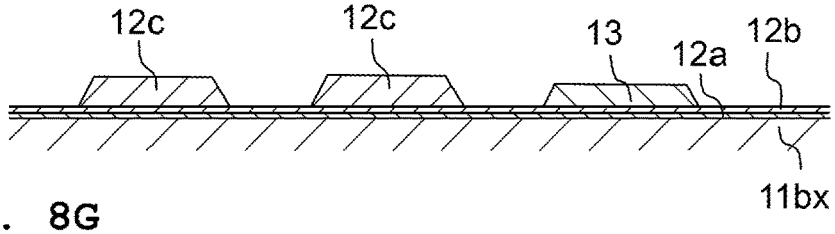
Figure 8G:
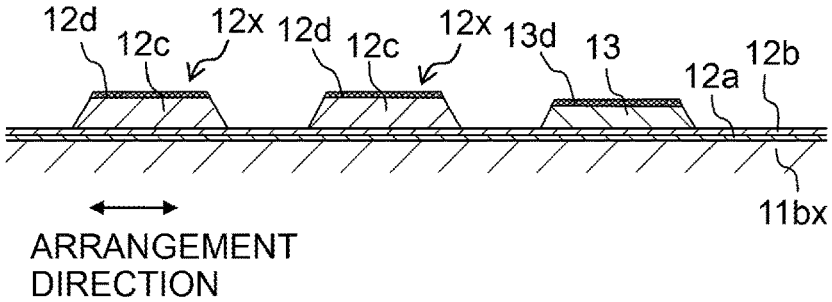

Next, as depicted in FIG. 8E, a layer 12*cx* to become later the piezoelectric bodies 12*c* is formed on the upper surface of the common electrode 12*b* by way of sol-gel method, sputtering or the like. Then, as depicted in FIG. 8F, another etching process is carried out to let the layer 12*cx* remain in the position facing each pressure chamber 11*m* and each adjacent dummy pressure chamber 11*md*1 (the position to form the pressure chamber 11*m* and the adjacent dummy pressure chamber 11*md*1 in a later process but, at this stage, the pressure chambers 11 and adjacent dummy pressure chambers 11*md*1 have not yet been formed in the silicon single crystal substrate 11*bx*), to form the piezoelectric bodies 12*c* (S4: piezoelectric body formation process). That is, the piezoelectric bodies 12*c* are formed on the upper surface of the vibration plate 12*a* in positions respectively facing the pressure chambers 11*m* and the adjacent dummy pressure chambers 11*md*1 via the common electrode 12*b*.

Next, as depicted in FIG. 8Q the individual electrodes 12*d* and the sensor electrodes 13*d* made of iridium (Ir) and platinum (Pt) are formed respectively on the upper surface of each piezoelectric body 12*c* and the upper surface of each temperature sensor 13 (S5), by way of using a mask or the like (S5). The individual electrodes 12*d* and the temperature sensors 13 are made of the same material with each other, and formed at the same time in this process. Through this process, the actuator 12 having the plurality of active portions 12*x* is formed.

Next, the protection film 12*i* is formed by way of sputtering with, for example, aluminum oxide (alumina: $Al_2O_3$) or the like as the target, on the upper surface of each individual electrode 12*d*, the upper surface of each sensor electrode 13*d*, such a part of the upper surface of the common electrode 12*b* as not provided with the temperature sensors 13, and the lateral side of each piezoelectric body 12*c* (S6; see FIG. 6).

Next, through holes are formed in such parts of the protection film 12*i* as overlapping with the individual electrodes 12*d* and the sensor electrodes 13*d* and, after the through holes are filled with the conductive material B, the wires 12*e* and 13*e* are formed (see FIG. 4). Then, the contact points 12*f* and 13*f* are formed at the fore-ends of the wires 12*e* and 13*e*. Further, through holes are formed for conducting the common electrode 12*b* and the common contact point 12*g* and, after the through holes are filled with a conductive material (not depicted), the common contact point 12*g* is formed (S7).

Next, the protection member 15 is adhered to a surface of the silicon single crystal substrate 11*bx* (S8).

Next, after grinding the silicon single crystal substrate 11*bx* until reaching to a predetermined thickness, the pressure chambers 11*m* and the dummy pressure chambers 11*md* are formed by way of etching the silicon single crystal substrate 11*bx* from the lower surface (S9). In this stage, the silicon single crystal substrate 11*bx* becomes the pressure chamber plate 11*b*.

Next, these members are joined together: the flow channel plate 11*c*, the protection plate 11*d*, the nozzle plate 11*e*, the reservoir member 11*a*, the COF 18, and the like (S10). In particular, first, the flow channel plate 11*c* is adhered to the lower surface of the pressure chamber plate 11*b*. Then, the protection plate 11*d* is adhered to the lower surface of the flow channel plate 11*c* via the damper film 11*v* and the spacer S and, furthermore, the nozzle plate 11*e* is adhered to the lower surface of the flow channel plate 11*c*. Then, the reservoir member 11*a* is adhered to the upper surface of the flow channel plate 11*c* and the upper surface of the protection member 15. Thereafter, the COF 18 is connected electrically to the respective contact points 12*f*, 13*f*, and 12*g*. With this, the head 1 is completed.

As described above, according to the first embodiment, the temperature sensor 13 is arranged on the upper surface of the vibration plate 12*a* in the position facing the distant dummy pressure chamber 11*md*2 (see FIGS. 5 and 6). Because the vibration plate 12*a* needs to be deformed in ink jetting, its thickness is comparatively small. By providing the temperature sensor 13 on vibration plate 12*a* of such kind at the position facing the distant dummy pressure chamber 11*md*2, it is possible to accurately detect the temperature of the ink inside the flow channel of the flow channel substrate 11.

No piezoelectric body 12*c* is provided on the upper surface of the vibration plate 12*a* at a position facing the distant dummy pressure chamber 11*md*2, while the temperature sensor 13 is provided (see FIG. 6). In this case, it is possible to make effective use of the space of the upper surface of the vibration plate 12*a*. Further, compared with a case of interposing the piezoelectric body 12*c* between the temperature sensor 13 and the distant dummy pressure chamber 11*md*2, there is a shorter distance between the temperature sensor 13 and the distant dummy pressure chamber 11*md*2. Therefore, it is possible to more accurately detect the temperature of the ink inside the flow channel of the flow channel substrate 11.

The dummy pressure chamber 11*md* is filled with the ink inside the flow channel substrate 11. In this case, it is possible to more accurately detect the temperature of the ink inside the flow channel of the flow channel substrate 11.

The flow channel substrate 11 is formed with the nozzles 11*n* in respective communication with the pressure chambers 11*m* to jet the ink, and the dummy nozzles 11*nd* in respective communication with the dummy pressure chambers 11*md* not to jet the ink (see FIG. 2). In this case, it is possible to discharge air bubbles inside the flow channels from the dummy nozzles 11*nd*.

The dummy pressure chambers 11*md* have the same shape and same size as the pressure chambers 11*m*. The pressure chambers 11*m* and the dummy pressure chambers 11*md* are arranged at regular intervals. Further, the dummy pressure chambers 11*md* may be positioned most outside (at the terminal) among the pressure chambers 11*m* and the dummy pressure chambers 11*md* in the arrangement direction (see FIG. 2). In this case, it is possible to suppress the problem that a difference arises in the shape of the pressure chambers 11*m* between the center and the terminal in the arrangement direction. As a result, a difference arises in the jet property.

The distant dummy pressure chambers 11*md*2 are further separated from the pressure chambers 11*m* than the adjacent dummy pressure chambers 11*md*1 in the arrangement direction. Then, the temperature sensors 13 are arranged at the positions facing the distant dummy pressure chambers 11*md*2 (see FIG. 6). In this case, it is possible to prevent the temperature sensors 13 from being damaged by the vibration of the vibration plate 12*a* in ink jetting.

The temperature sensor 13 is arranged on the common electrode 12*b* (see FIGS. 5 and 6). In this case, by using the common electrode 12*b* for ink jetting as the electrode of the temperature sensor 13, it is possible to simplify the structure and the manufacturing process.

The individual electrodes 12*d* are arranged on the upper surface of the piezoelectric bodies 12*c*, and the sensor electrode 13*d* is arranged on the upper surface of the temperature sensor 13 (see FIG. 6). In this case, it is possible to form the individual electrode 12*d* for ink jetting and the sensor electrode 13*d* for the temperature sensor 13 in the same process (see S5 of FIG. 7).

The sensor electrodes 13*d* are made of the same material as the individual electrodes 12*d* (such as iridium (Ir), Platinum (Pt), or the like). In this case, it is possible to easily realize the formation of the individual electrodes 12*d* and the sensor electrodes 13*d* through the same process.

The two temperature sensors 13 in the lower part of FIG. 2 are arranged on the upstream side of the pressure chambers 11*m* in the direction of the ink flowing in each manifold 11*s*2. By arranging the temperature sensors 13 at positions of less ink stagnation, the detecting accuracy increases.

The temperature sensor 13 has a smaller thickness than the piezoelectric body 12*c* (see FIG. 6). If the temperature sensor 13 has a large thickness, then the temperature sensor 13 will increase in rigidity. Hence, it is possible to adversely affect the drive of the actuator 12. Further, it is possible to decrease the etching accuracy in forming the temperature sensor 13 by way of etching. In this regard, according to the aforementioned configuration, because the temperature sensor 13 has a comparatively small thickness, it is possible to reduce the possibility of giving rise to such problems.

In the manufacturing method of the first embodiment, after the temperature sensor formation process S3, the piezoelectric body formation process S4 is carried out (see FIGS. 7 and 8A to 8G). If the piezoelectric body formation process S4 is carried out before the temperature sensor formation process S3, then the piezoelectric bodies 12*c* will be scraped off in the etching of the layer 13*x* such that driving the actuator 12 may be adversely affected. In this regard, according to the aforementioned configuration, it is possible to reduce the possibility of giving rise to such a problem.

In the temperature sensor formation process S3, the layer 13*x* is formed by way of sputtering. In this case, because no firing process is needed, it is possible to reduce the manufacturing cost.

Second Embodiment

Figure 9:
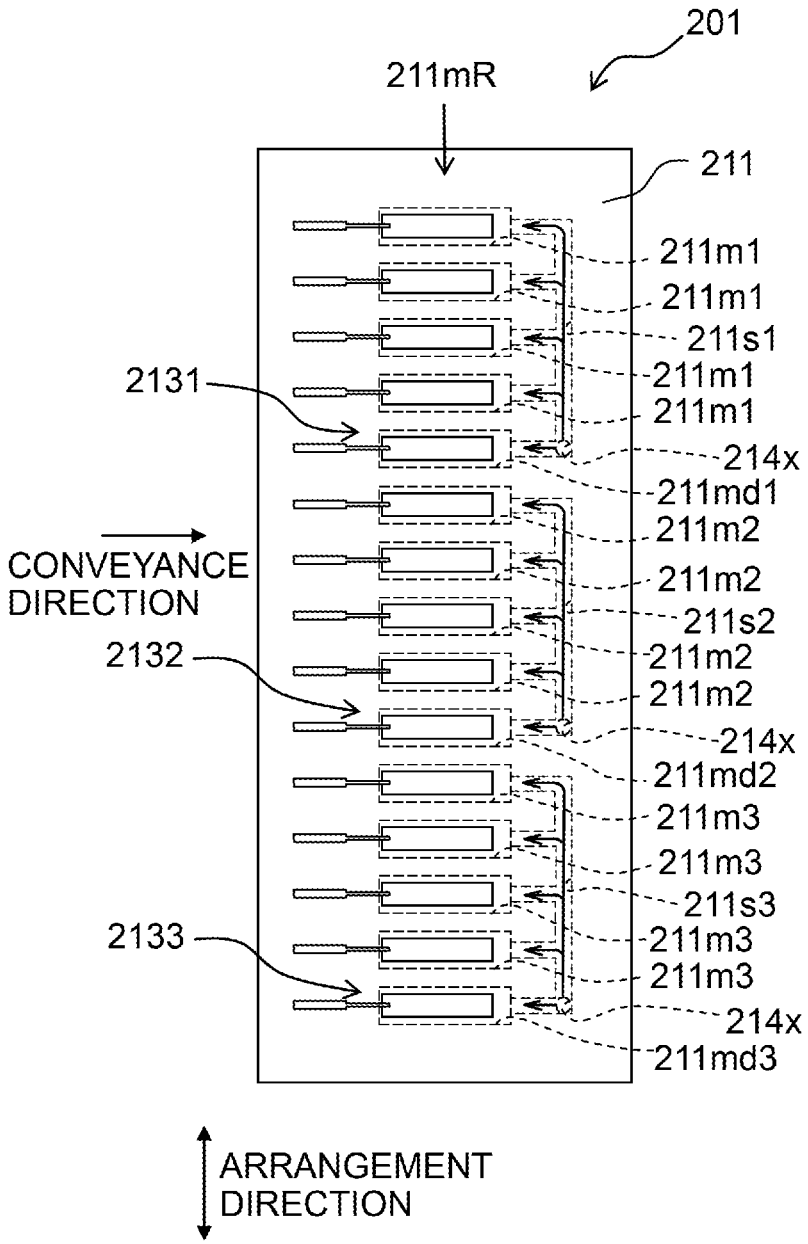
FIG. 9 is a plan view of a head according to a second embodiment of the present teaching and corresponding to FIG. 2.

Next, referring to FIG. 9, an explanation will be made on a head 201 according to a second embodiment of the present teaching, with respect to aspects different from the head 1 of the first embodiment. While the head 1 includes the flow channel substrate 11 where the single color ink flows, the head 201 is capable of corresponding to color printing and three color inks flow in a flow channel substrate 211.

In particular, the head 201 has the flow channel substrate 211 formed therein with a first flow channel 211*s*1 through which a yellow ink flows, a second flow channel 211*s*2 through which a cyan ink flows, and a third flow channel 211*s*3 through which a black ink flows. The flow channels 211*s*1 to 211*s*3 are supplied with the inks from an ink tank retaining the color inks (not depicted), respectively, via supply ports 214*x*.

Pressure chambers are arranged in an arrangement direction (a direction orthogonal to a conveyance direction) to form one pressure chamber row 211*m*R. The pressure chambers include four first pressure chambers 211*m*1 belonging in the first flow channel 211*s*1, four second pressure chambers 211*m*2 belonging in the second flow channel 211*s*2, and four third pressure chambers 211*m*3 belonging in the third flow channel 211*s*3. The four first pressure chambers 211*m*1, the four second pressure chambers 211*m*2, and the four third pressure chambers 211*m*3 form three groups of pressure chambers, and the three groups of pressure chambers are arranged along the arrangement direction.

Dummy pressure chambers are arranged in the arrangement direction, and include a first dummy pressure chamber 211*md*1, a second dummy pressure chamber 211*md*2, and a third dummy pressure chamber 211*md*3. The first dummy pressure chamber 211*md*1 is adjacent to the pressure chamber group formed of the four first pressure chambers 211*m*1 in the arrangement direction. The second dummy pressure chamber 211*md*2 is adjacent to the pressure chamber group formed of the four second pressure chambers 211*m*2 in the arrangement direction. The third dummy pressure chamber 211*md*3 is adjacent to the pressure chamber group formed of the four first pressure chambers 211*m*3 in the arrangement direction. The pressure chamber group formed of the four second pressure chambers 211*m*2 is arranged between the first dummy pressure chamber 211*md*1 and the second dummy pressure chamber 211*md*2. The pressure chamber group formed of the four third pressure chambers 211*m*3 is arranged between the second dummy pressure chamber 211*md*2 and the third dummy pressure chamber 211*md*3. The dummy pressure chambers 211*md*1 to 211*md*3 are arranged at regular intervals in the arrangement direction.

Temperature sensors include a first temperature sensor 2131, a second temperature sensor 2132, and a third temperature sensor 2133. The first temperature sensor 2131 is arranged at a position facing the first dummy pressure chamber 211*md*1. The second temperature sensor 2132 is arranged at a position facing the second dummy pressure chamber 211*md*2. The third temperature sensor 2133 is arranged at a position facing the third dummy pressure chamber 211*md*3. The temperature sensors 2131 to 2133 are arranged at regular intervals in the arrangement direction.

As described above, according to the second embodiment, the temperature sensors 2131 to 2133 are provided respectively for the dummy pressure chambers 211*md*1 to 211*md*3 corresponding to the respective colors. By virtue of this, it is possible to detect the ink temperature according to each color, inside the flow channels formed in the flow channel substrate 211 for the plurality of colors.

Further, because the temperature sensors 2131 to 2133 are arranged at regular intervals in the arrangement direction, it is possible to more accurately detect the temperature according to each color.

Further, if the temperature sensors are provided for each color (for each group of pressure chambers) as in the second embodiment, then it is possible to detect the temperature for each group of the pressure chambers. In this case, the jet control may be carried out based on the temperature detected for each group of the pressure chambers. Alternatively, an average value of the temperatures detected respectively for the plurality of groups may be calculated and, based on the average value, the jet control may be carried out for all pressure chambers.

Third Embodiment

Figure 10:
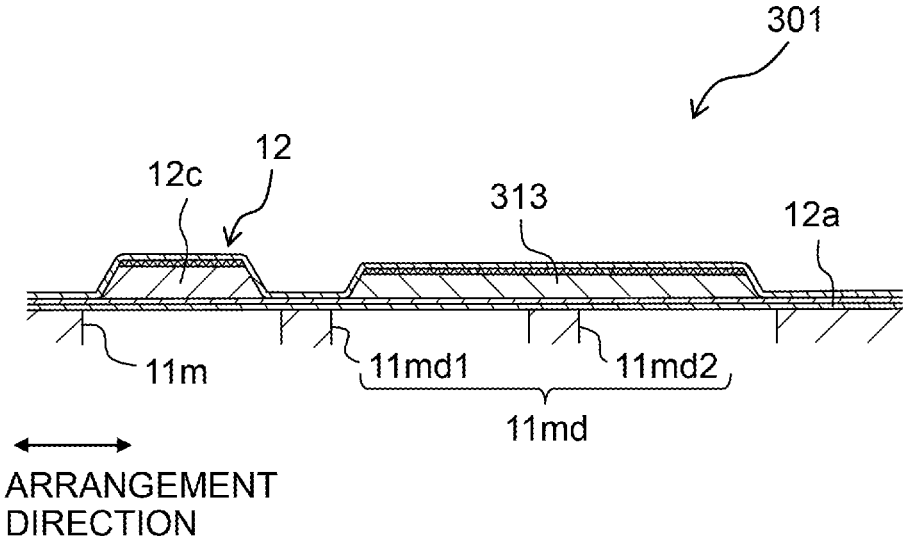
FIG. 10 is a plan view of a head according to a third embodiment of the present teaching and corresponding to FIG. 6.

Next, referring to FIG. 10, an explanation will be made on a head 301 according to a third embodiment of the present teaching, with respect to aspects different from the head 1 of the first embodiment. While the temperature sensor 13 of the head 1 is provided in a position facing each distant dummy pressure chamber 11*md*2, each temperature sensor 313 of the head 301 is arranged across two dummy pressure chambers 11*md* (adjacent dummy pressure chamber 11*md*1 and distant dummy pressure chamber 11*md*2).

The piezoelectric body 12*c* of the actuator 12 is arranged in a position facing the pressure chamber 11*m*, but not arranged in positions facing the adjacent dummy pressure chamber 11*md*1 and the distant dummy pressure chamber 11*md*2.

According to the third embodiment, the temperature sensor 313 is arranged across the plurality of dummy pressure chambers 11*md*. Therefore, the temperature sensor 313 has a larger area facing the vibration plate 12*a*, thereby increasing its detecting accuracy.

Hereinabove, a few preferred embodiments of the present teaching were explained. However, the present teaching is not limited to the above embodiments, but can undergo various design changes and/or modifications without departing from the true scope and spirit set forth in the appended claims.

Modifications

In the above embodiments, the piezoelectric body is provided for each pressure chamber. However, one piezoelectric body may be provided across a plurality of pressure chambers.

Wires and contact points may not be provided for the individual electrodes provided in positions facing the adjacent dummy pressure chambers. Alternatively, piezoelectric bodies and individual electrodes may not be provided in positions facing the adjacent dummy pressure chambers. A temperature sensor may be provided in a position facing the adjacent dummy pressure chamber.

The dummy nozzles in communication with the dummy pressure chambers may not be provided. The dummy pressure chambers may not be filled with the liquid inside the flow channel substrate. For example, the dummy pressure chambers may function as spaces for letting out the adhesive for attaching the vibration plate on the flow channel substrate. The dummy pressure chambers may have different shape and size from the pressure chambers. One pressure chamber may be provided at each of the two opposite terminals of each pressure chamber row according to the arrangement direction.

The plurality of pressure chambers and the plurality of dummy pressure chambers are not limited to being arranged at regular intervals in the arrangement direction. For example, the pressure chambers and the dummy pressure chambers positioned at the terminals may have longer interval than between the pressure chambers according to the arrangement direction. The dummy pressure chambers may be arranged between the plurality of pressure chambers arranged in the arrangement direction.

The number of the pressure chamber rows is not limited to two but may be one or three or more. Further, the pressure chambers may not be arranged to form pressure chamber rows.

The temperature sensors may be arranged via some kind of member (the common electrode in the above embodiments) on the other surface of the vibration plate than the surface facing the pressure chambers, or be arranged directly on that surface (that is, in contact with that surface). The temperature sensors may have a dedicated electrode for the temperature sensors but not share between the actuator and the electrode (the common electrode in the above embodiments). The electrodes for the temperature sensors are not limited to being made of the same material as the individual electrodes. The electrodes for the temperature sensors may be formed through a different process from the individual electrodes. The temperature sensors are not limited to being made of a combined mental oxide but may be made of an alloy of aluminum, chrome and boron, and the like. The temperature sensor is not limited to a thermistor but may be a thermal diode or the like. The temperature sensor is not limited to being formed by way of sputtering but may be formed by another arbitrary method. The temperature sensor may be thicker than the piezoelectric body. With respect to the direction of the liquid flowing in the supply flow channels, the temperature sensor may be arranged only on the downstream side of the pressure chambers. The temperature sensors are not limited to a multiple number but may be one or more. If temperature sensors are provided, then the temperature sensors are not limited to a specific positional relation therebetween (for example, while the plurality of temperature sensors are arranged at regular intervals in the second embodiment, the plurality of temperature sensors may be arranged not at regular intervals).

In the second embodiment, the flow channels for the three colors are formed in the flow channel substrate. However, the flow channels for two colors or for four colors or for more colors may be formed in the flow channel substrate. In such cases, too, the temperature sensor may be provided for each color.

The vibration plate is not limited to being made of a film of silicon dioxide formed by oxidizing a surface of a silicon single crystal substrate, but may be a plate made of a piezoelectric plate or a metal plate. In such cases, the vibration plate may be attached on a surface of the flow channel substrate in the vibration plate formation process.

In the vibration plate formation process, the temperature sensor formation process, and the piezoelectric body formation process, the pressure chambers and the dummy pressure chambers are not formed in the flow channel substrate in the above embodiments. However, without being limited to that, the vibration plate formation process, the temperature sensor formation process, and/or the piezoelectric body formation process may be carried out after forming the pressure chambers and the dummy pressure chambers in the flow channel substrate.

The feedback flow channels may not be formed in the flow channel substrate (that is, not be limited to the configuration of circulating the inks between the retainment chambers and the respective pressure chambers). The flow channel substrate is not limited to being configured by attaching a plurality of members on each other, but may be formed of a single member.

The liquid jetting head is not limited to a line type but may apply a serial type (such as a type of causing the head to scan along a direction orthogonal to the arrangement direction while jetting a liquid on a recording medium conveyed along the conveyance direction parallel to the arrangement direction). Further, the liquid jet apparatus is not limited to having a head unit including a plurality of liquid jetting heads, but may have a single liquid jetting head. The liquid jetted by the liquid jetting head is not limited to ink but may be any liquid (such as a treatment liquid or the like agglutinating or precipitating the ingredients of the ink). The recording medium is not limited to paper but may be any recordable medium (such as cloth or the like). The present teaching is not limited to printers but may also be applied to facsimiles, copy machines, multifunction peripheries, and the like.

What is claimed is:

1. A liquid jetting head comprising:

a flow channel substrate in which pressure chambers are formed;

an actuator covering the pressure chambers; and a temperature sensor, wherein a dummy pressure chamber is formed in a surface, of the flow channel substrate, in which the pressure chambers are open;

the actuator includes:

a vibration plate covering the pressure chambers and the dummy pressure chamber and having a first surface facing the pressure chambers and a second surface opposite to the first surface; and a piezoelectric body arranged on the second surface of the vibration plate to face the pressure chambers, and the temperature sensor is arranged on the second surface of the vibration plate at a position facing the dummy pressure chamber.

2. The liquid jetting head according to claim 1, wherein the piezoelectric body is not provided at the position facing the dummy pressure chamber on the second surface of the vibration plate.

3. The liquid jetting head according to claim 1, wherein the dummy pressure chamber is filled with liquid which flows inside the flow channel substrate.

4. The liquid jetting head according to claim 3, wherein the flow channel substrate is formed with nozzles which communicate with the pressure chambers respectively and from which the liquid is jetted, and a dummy nozzle which communicates with the dummy pressure chamber and from which the liquid is not jetted.

5. The liquid jetting head according to claim 1, wherein the dummy pressure chamber has the same shape and size as each of the pressure chambers, the pressure chambers and the dummy pressure chamber are arranged at regular intervals along an arrangement direction of the pressure chambers, and the dummy pressure chamber is positioned at most outside in the arrangement direction among the pressure chambers and the dummy pressure chamber.

6. The liquid jetting head according to claim 1, wherein the pressure chambers are arranged to form one or more pressure chamber rows, the dummy pressure chamber is one of dummy pressure chambers opening in the surface of the flow channel substrate, the dummy pressure chambers are arranged in an arrangement direction of the pressure chambers, the dummy pressure chambers include an adjacent dummy pressure chamber which is adjacent to one pressure chamber row among the one or more pressure chamber rows in the arrangement direction, and a distant dummy pressure chamber which is distant further from the one pressure chamber row than the adjacent dummy pressure chamber in the arrangement direction, and the temperature sensor is arranged at a position facing the distant dummy pressure chamber.

7. The liquid jetting head according to claim 6, wherein the temperature sensor is arranged across the dummy pressure chambers.

8. The liquid jetting head according to claim 1, wherein the actuator includes a common electrode which is common to the pressure chambers and arranged between the vibration plate and the piezoelectric body to face the pressure chambers and the dummy pressure chamber, and the temperature sensor is arranged on the common electrode.

9. The liquid jetting head according to claim 1, wherein the actuator includes individual electrodes corresponding to the pressure chambers respectively, the individual electrodes are arranged on a surface of the piezoelectric body on a side opposite to the vibration plate at positions facing the pressure chambers respectively, and an electrode for the temperature sensor is arranged on a surface of the temperature sensor on a side opposite to the vibration plate.

10. The liquid jetting head according to claim 9, wherein the electrode for the temperature sensor is made of the same material as the individual electrodes.

11. The liquid jetting head according to claim 1, wherein the temperature sensor is made of a material in which electric resistance is changed depending on temperature.

12. The liquid jetting head according to claim 11, wherein the material is combined metal oxide.

13. The liquid jetting head according to claim 1, wherein the flow channel substrate is formed with a supply flow channel configured to supply liquid to each of the pressure chambers from a storing chamber storing the liquid, and the temperature sensor is arranged on an upstream side of the pressure chambers in a flow direction of the liquid in the supply flow channel.

14. The liquid jetting head according to claim 1, wherein the flow channel substrate is formed with a first flow channel through which a first color liquid flows and a second flow channel through which a second color liquid flows, the pressure chambers are arranged to form one or more pressure chamber row, the pressure chambers include a first pressure chamber and a second pressure chamber arranged along an arrangement direction of the pressure chambers, the first pressure chamber belonging to the first flow channel, the second pressure chamber belonging to the second flow channel, the dummy pressure chamber is one of dummy pressure chambers opening in the surface of the flow channel substrate, the dummy pressure chambers include a first dummy pressure chamber and a second dummy pressure chamber arranged in the arrangement direction, the first dummy pressure chamber being adjacent to the first pressure chamber in the arrangement direction, the second dummy pressure chamber being adjacent to the second pressure chamber in the arrangement direction, and the temperature sensor includes a first temperature sensor arranged at a position facing the first dummy pressure chamber, and a second temperature sensor arranged at a position facing the second dummy pressure chamber.

15. The liquid jetting head according to claim 14, wherein the flow channel substrate is further formed with a third flow channel through which a third color liquid flows, the pressure chambers further include a third pressure chamber which belongs to the third flow channel and which is aligned with the first pressure chamber and the second pressure chamber in the arrangement direction, the dummy pressure chambers further include a third dummy pressure chamber adjacent to the third pressure chamber in the arrangement direction, the temperature sensor further includes a third temperature sensor arranged at a position facing the third dummy pressure chamber, and the first temperature sensor, the second temperature sensor, and the third temperature sensor are arranged in the arrangement direction at regular intervals.

16. The liquid jetting head according to claim 1, wherein thickness of the temperature sensor is smaller than thickness of the piezoelectric body.

* * * * *